United States Patent [19]

Niessner

[11] Patent Number: 4,963,784

[45] Date of Patent: Oct. 16, 1990

[54] SPARK PLUG HAVING COMBINED SURFACE AND AIR GAPS

[75] Inventor: Werner Niessner, Steinheim, Fed. Rep. of Germany

[73] Assignee: Beru Reprecht GmbH & Co. KB, Ludwigsburg, Fed. Rep. of Germany

[21] Appl. No.: 353,774

[22] Filed: May 18, 1989

[30] Foreign Application Priority Data

May 18, 1988 [DE] Fed. Rep. of Germany ..... 3816968

[51] Int. Cl.[5] ..... H01T 13/52

[52] U.S. Cl. ..... 313/131 R; 313/143

[58] Field of Search ..... 313/130, 131, 131 A, 313/141, 143

[56] References Cited

U.S. PATENT DOCUMENTS 3,890,519 6/1975 Chafer et al. ..... 313/130

4,795,937 1/1989 Wagner et al. ..... 313/131

FOREIGN PATENT DOCUMENTS 3532472 3/1987 Fed. Rep. of Germany .

*Primary Examiner*—Sandra L. O'Shea

*Attorney, Agent, or Firm*—Sixbey, Friedman, Leedom & Ferguson

[57] ABSTRACT

A spark plug with combined surface discharge and air discharge gaps, wherein a central electrode (3), an insulator (2) surrounding the central electrode, and a ground electrode (4) surrounding the insulator (2) together with a spark plug body (1) are provided. The insulator (2) forms at its end portion a discharge chamber (5) through which the central electrode (3) extends axially as far as the end portion of the spark plug body (1). The earth electrode surrounds the insulator (2) around its end with a projection extending into the discharge chamber (5).

20 Claims, 3 Drawing Sheets

IGNITION VOLTAGE AS A FUNCTION OF COMPRESSIVE PRESSURE

SPARK PLUG HAVING COMBINED SURFACE AND AIR GAPS

BACKGROUND OF THE INVENTION

The invention relates to a spark plug with combined surface discharge and air discharge gaps having a central electrode, an insulator surrounding the central electrode, and a ground electrode surrounding the insulator together with a spark plug body, wherein the insulator at its end portion is at a distance from the central electrode and forms a discharge chamber into which the central electrode extends, and the ground electrode surrounds the insulator around its end with a projection extending into the discharge chamber.

Such a spark plug is known from German Patent No. 3 544 176 and corresponding to U.S. Pat. No. 4,795,937. In this known spark plug the central electrode extends slightly into the discharge chamber which the insulator forms in that it extends in the axial direction of the plug over the central electrode, the insulator, at any rate in the end area of the central electrode, retaining a gap relative to it, and also the ground electrode, at any rate in the end region of the insulator, retaining a gap relative to the latter.

With such an arrangement there arise extensive sparking distances extending over the entire length of the discharge chamber and, with an adequately fast voltage rise at the spark plug capacitance and independently of the compression pressure of the mixture to be ignited, much ignition energy is converted in the gas and thereby practically long life is achieved.

The known spark plug according to German Patent No. 3 544 176, however, still suffers from the drawback that, on the starting of an internal combustion engine in which such a plug is used, high voltage is required, such as e.g. 30 kV. As, furthermore, with the known plug the surface ignition spark always runs over the ceramic insulator, this being associated with corresponding wear of the insulator, the life of the known plug is not yet optimum.

SUMMARY OF THE INVENTION

The problem at the basis of the invention therefore consists in designing a spark plug of the initially mentioned type in such a manner that its voltage requirement is relatively low for a simultaneously higher conversion of power in the ignitable fuel-air mixture.

With the spark plug of the invention, preferably lean mixtures also should be able to be ignited, and, as a result of the spark plug geometry, the emissions of harmful substances in the exhaust gases of an internal combustion engine, should be able to be kept as low as possible.

This problem is solved according to the invention by means of the construction wherein the central electrode extends axially through the discharge chamber as far as the end portion of the spark plug body.

In the spark plug of the invention, therefore, the central electrode is drawn forward in such a way that it ends in the end portion of the plug body, so that in the forward region of the plug an air spark gap is formed, and at the same time the discharge chamber forms a forward chamber which permits surface discharges. With the construction of the invention, therefore, the advantages of a pre-chamber plug are utilized. The spark plug of the invention has, in addition, a long life.

This means in particular that the discharge form is determined by the load condition of the engine, the dynamic pressure conditions of the compression and of the turbulent flow of mixture determining the discharge form. This means in practice that on a running of the engine there arise either air discharges or surface discharges, or partly air discharges and partly surface discharges, depending on pressure conditions. It is to be seen in this connection that an air discharge forms on low compression, and that on high compression the spark discharge prevails on the intended surface discharge gap.

These forms of discharge effect in particular that on an air discharge, on the one hand the mixture is ignited in the main combustion chamber, i.e. in the engine cylinder, and on the other hand the ignitable mixture is simultaneously ignited in the pre-chamber. The chemical energy of the pre-chamber is additionally transmitted into the main combustion chamber by expansion forces. This additional chemical energy effects an additional ignition and provides therefore for a reliable through-combustion of the mixture. On the operation of the spark plug as surface discharge plug the ignition mixture is ignited in the prechamber. As the surface spark passes quickly through the entire pre-chamber, any old gas cores have almost no negative effects, so that the locally ignitable mixture is ignited in the pre-chamber, and the ignited pre-chamber mixture is pressed with the excess pressure arising into the main combustion space.

By the combination of the air spark gaps and surface spark gaps a lengthy life is altogether achieved as the burn-off surfaces on the central electrode or earth electrode and the surface spark gaps are very great. As pressure increases the base of the sparks then travels deeper and deeper on the entire free electrode length into the discharge chamber. The ceramic surface discharge paths, i.e. the surface discharge paths on the ceramic insulator are here protected by an annular ground electrode which surrounds the insulator from the outside inwards around the insulator end.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
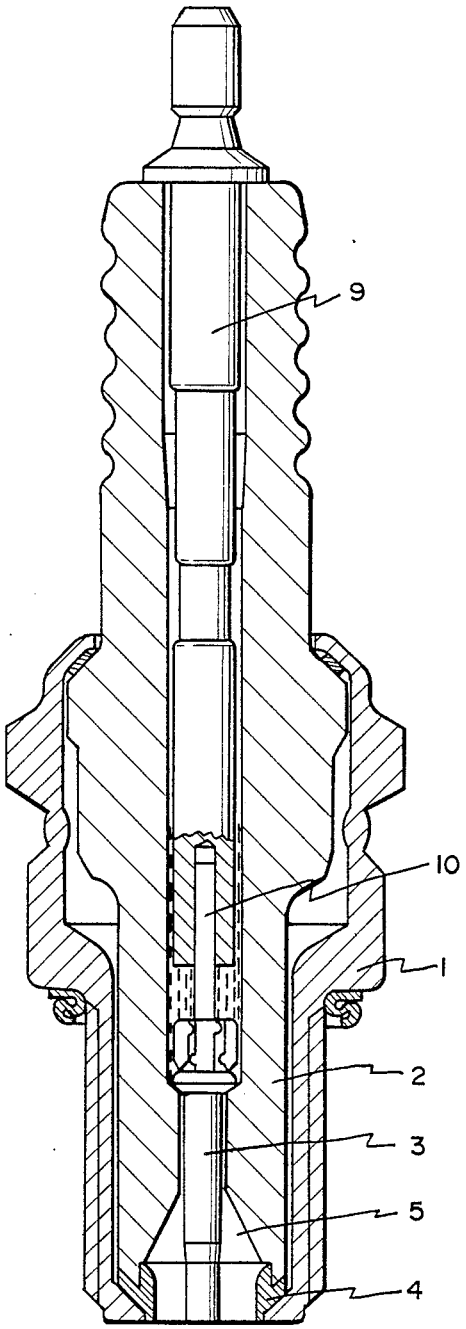
FIG. 1 is an axial sectional view of the example of embodiment of the spark plug of the invention.

The example of embodiment shown in FIG. 1 of the spark plug of the invention essentially comprises a metal spark plug body 1 with a screw thread, a ceramic insulator 2, a central electrode 3 and an annular ground electrode 4. The insulator 2 is surrounded by the spark plug body 1 together with the annular ground electrode 4.

In a known manner from German Offenlegungsschrift 35 32 472, a low impedance connection is formed between central electrode 3 and an ignition pin 9 by means of a contact pin 10 that is fixed at the central electrode and soldered to the ignition pin 9. for this purpose, the contact pin 10 an be provided with a silver layer as a soldering agent.

In the forward, i.e. in the spark plug side region of the insulator 2, there is provided a pre-chamber of discharge chamber 5 in the form of a recess, which is preferably designed V-shaped in axial section with cross-section widening towards the insulator end. The ground electrode 4 annularly surrounds from outside inwards the insulator 2 at the insulator end. The ground electrode, at the end of its projection encompassing the insulator and extending into the discharge chamber, is designed rounded-off, to prevent field distortions, so that the spark, on the one hand, in the case of surface discharges does not lift off prematurely from the surface discharge path, and on the other hand, in the case of air discharges the spark builds up as far as possible forward in the direction of the main combustion chamber, as will be described in greater detail below on the basis of FIG. 3.

The central electrode 3 is, according to the standard technology, introduced and pressure sealed in the insulator 2, for example by glass fusing, etc. There may be used as the electrode material for the central electrode 3 known materials such as silver, nickel alloys, platinum composite materials or conducting or semi-conducting ceramics. Two-material electrodes may also be used.

The ground electrode 4 is so designed that it operates simultaneously as a seal between the spark plug body 1 and the insulator 2.

As shown in FIG. 1 the central electrode 3 extends axially through the pre-chamber of discharge chamber as far as the end portion of the plug body 1 on which the ground electrode 4 is provided.

The spark plug shown in FIG. 1 has a thermal value proceeding in the direction of very cold plugs. This plug may be used in connection with an ignition of very steep voltage rise of e.g. 3 kV/ns in all internal combustion engines, as it is very cold and a shunt is of no importance. It represents therefore a universal domestic spark plug for which a shunt of up to one kOhm is possible and permissible.

Figure 2:
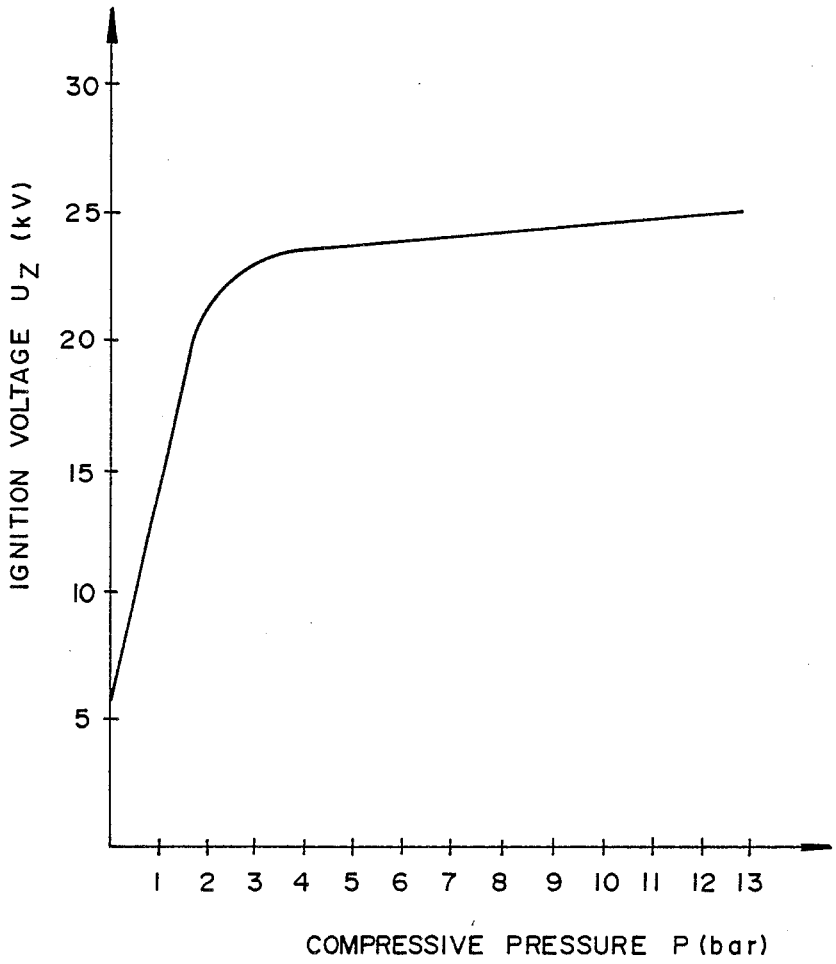
FIG. 2 shows a diagram of the ignition voltage requirement depending upon compressive pressure in the example of embodiment of the spark plug of the invention.

In FIG. 2 the characteristic of the ignition voltage requirement has been shown for an example of embodiment of the spark plug of the invention. FIG. 2 thus shows the dependence of ignition voltage upon compression.

As shown in FIG. 2 the voltage requirement of the plug does not rise pro rata with compression, but the ignition voltage requirement, on increased compression, is influenced by surface discharge. As surface sparks are almost independent of pressure, the ignition voltage requirement does not rise linearly further, but the ignition voltage requirement remains almost constant. This means that in spite of great sparking discharge distances of the sparks a relatively low voltage requirement of, e.g., less than 25 kV is achieved.

Figure 3:
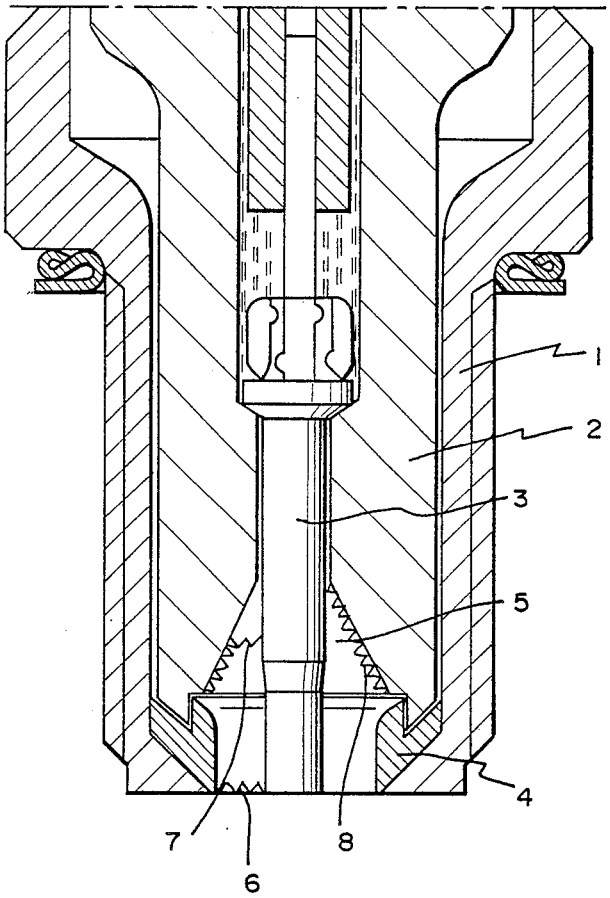
FIG. 3 shows in a sectional view of the ignition spark side end of the example of embodiment of the spark plug of the invention the formation of the ignition sparks.

FIG. 3 shows in detail the formation of the sparks at the forward end portion of the example of embodiment of the spark plug of the invention. Here, the spark formation is represented correspondingly to the prevailing compression and compressive pressures of the engine.

At low pressures the ignition spark forms in the forward region on the air discharge gap 6. As pressure rises the spark forms as air and surface spark 7, and at high pressure the discharge goes over into a pure surface discharge 8. The entire region of the central electrode 3 which protrudes into the pre-chamber 5 is used as burn-up surface. As a result a longer life of the plug is to be expected.

If the spark plug is operated with an ignition system of very steep voltage rise of, e.g., 3 kV/ns and a potential energy greater than or equal to 30 smJ, several spark paths are formed in all load conditions, as a plasma channel cannot carry the high currents alone.

The constructional arrangement of the sparking distance of the air spark formation (electrode distance) and the arrangement of the surface discharge path in the insulator must be carried out according to the engine compression. Realistic values for spark ignition engines should be, for an air discharge path, from 2.0 to 2.5 mm, and for a surface discharge path, some 5 mm.

Thus we arrive at the special characteristic shown in FIG. 2 of the response voltage with a regulating effect of the voltage requirement at high pressures, where, depending on the pressure, sometimes air, sometimes surface spark discharges are possible and the spark starts at various points of the central electrode shell surface, depending on pressure, and leads to optimum burn-up conditions. The air and surface discharge paths are so arranged that the spark discharge occurs correspondingly to the engine pressure conditions with sliding transition areas either at the air spark gap or at the surface spark gap. Here, the pre-chamber or discharge chamber acts as surface spark gap, and the air spark gap forms between the central electrode and the annular earth electrode.

Measurements of the response voltage or of the voltage requirements have shown in particular that, as opposed to series spark plugs, for the same electrode distance, a smaller response voltage could be noted. Here the arrangement of the electrodes, i.e. the electric field configuration is decisive for the electrodes. In spite of its electrode distances of 2.00 mm the response voltage on engine operation was at a maximum of 25 kV, a certain regulating effect making itself felt at high compressions. If the response voltage at the air discharge path is too high, the spark begins to move along the surface, the surface discharges being then almost dependent upon pressure. Thus the ignition voltage requirement of the spark plug may be designed, for a high pressure also, at the desired values by constructional measures. In this connection it should be remembered that the spark discharge forms at low pressure at the air discharge gap, and when pressure increases the spark goes over to a surface discharge, and in fact, in the manner shown in FIG. 2, with a surface transition from the spark at low pressure, at medium pressure and at high pressure. The discharge form is thus determined by pressure conditions in the engine, so that a very great area of the central electrode is effective, and consequently a long life is to be expected.

The spark plug described in suitable for igniting lean mixtures, leads to a smaller content in harmful substances in the exhaust gas, has a longer life, and, for a great electrode distance of e.g. 2 mm, exhibits only a relatively small voltage requirement of, e.g. 25 kV, a high amount of energy in the fuel-air mixture being converted at the same time.

What is claimed is:

1. A spark of the type having combined surface discharge and air discharge gaps, wherein said spark plug comprises a spark plug body, a central electrode, an insulator surrounding the central electrode, and a ground electrode, wherein the ground electrode surrounds the insulator together with the spark plug body; wherein the insulator has an end portion at a radial distance from the central electrode which forms a discharge chamber into which the central electrode extends; wherein said ground electrode surrounds the end portion of the insulator and has a projection extending into the discharge chamber; and wherein the central electrode extends axially through the discharge chamber as far as an end portion of the spark plug body as a means for enabling an air and surface spark to be produced as well as air gap and pure surface discharges.

2. The spark plug according to claim 1, wherein the discharge chamber has a generally V-shaped axial cross-section which widens towards the end portion of the insulator.

3. The spark plug according to claim 1, wherein the discharge chamber is formed within said insulator end portion and said insulator comprises an electrically insulating ceramic forming a surface discharge path.

4. The spark plug according to claim 2 wherein the projection of the ground electrode extending into the discharge chamber is rounded as a means for preventing field distortions.

5. The spark plug according to claim 4, wherein the central electrode is formed of a conductive or semi-conductive ceramic material.

6. The spark plug according to claim 5, wherein the central electrode is low-impedance-connected with an igniter.

7. The spark plug according to claim 4, wherein the central electrode is low-impedance-connected with an igniter.

8. The spark plug according to claim 1, wherein the central electrode is of a conductive or semi-conductive ceramic material.

9. The spark plug according to claim 8 wherein the central electrode is low-impedance-connected with an igniter.

10. The spark plug according to claim 1, wherein the central electrode is low-impedance-connected with an igniter.

11. The spark plug according to claim 2, wherein the central electrode is of a conductive or semi-conductive ceramic material.

12. The spark plug according to claim 11 wherein the central electrode is low-impedance-connected with an igniter.

13. The spark plug according to claim 2, wherein the central electrode is low-impedance-connected with an igniter.

14. The spark plug according to claim 3, wherein the central electrode is of a conductive or semi-conductive ceramic material.

15. The spark plug according to claim 14, wherein the central electrode is low-impedance-connected with an igniter.

16. The spark plug according to claim 3, wherein the central electrode is low-impedance-connected with an igniter.

17. A spark of the type having combined surface discharge and air discharge gaps, wherein said spark plug comprises a spark plug body, a central electrode, an insulator surrounding the central electrode, and a ground electrode, wherein the ground electrode surrounds the insulator together with the spark plug body; wherein the insulator has an end portion at a radial distance from the central electrode which forms a discharge chamber into which the central electrode extends; wherein said ground electrode surrounds the end portion of the insulator and has a projection extending into the discharge chamber; and wherein the central electrode extends axially through the discharge chamber as far as an end portion of the spark plug body wherein an end of the projection of the ground electrode extending into the discharge chamber is rounded as a means for preventing field distortions.

18. The spark plug according to claim 17 wherein the central electrode is of a conductive or semi-conductive ceramic material.

19. The spark plug according to claim 18, wherein the central electrode is low-impedance-connected with an igniter.

20. The spark plug according to claim 17, wherein the central electrode is low-impedance-connected with an igniter.

* * * * *